US007011507B2

(12) United States Patent
Seto et al.

(10) Patent No.: US 7,011,507 B2
(45) Date of Patent: Mar. 14, 2006

(54) POSITIVE DISPLACEMENT PUMP WITH A COMBINED INERTANCE VALUE OF THE INLET FLOW PATH SMALLER THAN THAT OF THE OUTLET FLOW PATH

(75) Inventors: Takeshi Seto, Chofu (JP); Kunihiko Takagi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 10/430,314

(22) Filed: May 7, 2003

(65) Prior Publication Data

US 2004/0013548 A1 Jan. 22, 2004

(30) Foreign Application Priority Data

Jun. 4, 2002 (JP) ..... 2002-163384
Jun. 6, 2002 (JP) ..... 2002-166248
Jun. 6, 2002 (JP) ..... 2002-166249
Jan. 9, 2003 (JP) ..... 2003-003330

(51) Int. Cl.
*F04B 43/02* (2006.01)

(52) U.S. Cl. ..... 417/412; 417/413.1; 417/413.2; 417/307; 417/440; 417/441

(58) Field of Classification Search ..... 417/307, 417/413.2, 440, 441, 557, 412, 413.1
See application file for complete search history.

(56) References Cited

U.S. PATENT DOCUMENTS 2,968,963 A * 1/1961 Hazlett ..... 476/67
3,393,641 A * 7/1968 Miedaner et al. ..... 137/209
3,657,930 A 4/1972 Jacobson
3,950,761 A * 4/1976 Kashio ..... 347/85
4,730,197 A 3/1988 Raman et al.
4,743,169 A * 5/1988 Funakawa et al. ..... 417/306
4,887,100 A 12/1989 Michaelis et al.

(Continued)

FOREIGN PATENT DOCUMENTS

CH 280618 1/1952

(Continued)

OTHER PUBLICATIONS

Anders Olsson et al.; "An Improved Valve-Less Pump Fabricated Using Deep Reactive Ion Etching"; IEEE; 1996; pp 479-484.

*Primary Examiner*—Charles G. Freay
*Assistant Examiner*—Emmanuel Sayoc
(74) *Attorney, Agent, or Firm*—Oliff & Berridge, PLC

(57) ABSTRACT

A pump according to the present invention has a circular diaphragm 4 placed at the bottom of a casing 2. At the bottom of the diaphragm 4, a piezoelectric element 6 is installed in contact with the diaphragm 4. A narrow space between the diaphragm 4 and the top wall of the casing 2 constitutes a pumping chamber 8. An inlet flow path 12 and an outlet flow path 14 are open to the pumping chamber 8, wherein a check valve 10 is installed in the inlet flow path 12. Immediately downstream of the pumping chamber, the outlet flow path 14 has a narrow segment 16. The narrow segment 16 of the outlet flow path has ½ the diameter and ¼ the cross sectional area of the outlet flow path 14. The outlet flow path 14 has a return inlet 22, which is connected to a return outlet 23 in the inlet flow path via an active valve 24. The active valve 24 is opened and closed freely by an actuator 26 made of shape-memory alloy.

6 Claims, 8 Drawing Sheets

U.S. PATENT DOCUMENTS

| | | | | |
|---|---|---|---|---|
| 5,215,446 | A * | 6/1993 | Takahashi et al. | 417/322 |
| 5,259,737 | A * | 11/1993 | Kamisuki et al. | 417/322 |
| 5,438,350 | A | 8/1995 | Kerry | |
| 5,462,413 | A | 10/1995 | Schroeder | |
| 5,897,299 | A * | 4/1999 | Fukunaga | 417/316 |
| 6,042,344 | A * | 3/2000 | Lifson | 417/310 |
| 6,203,291 | B1 | 3/2001 | Stemme et al. | |
| 6,227,809 | B1 | 5/2001 | Forster et al. | |
| 6,623,256 | B1 * | 9/2003 | Takagi et al. | 417/413.2 |

FOREIGN PATENT DOCUMENTS

| | | |
|---|---|---|
| DE | 25 19 962 | 11/1976 |
| EP | 1 236 900 A1 | 9/2002 |
| JP | A 8-312537 | 11/1996 |
| JP | A 9-32723 | 2/1997 |
| JP | A 10-220357 | 8/1998 |

* cited by examiner

POSITIVE DISPLACEMENT PUMP WITH A COMBINED INERTANCE VALUE OF THE INLET FLOW PATH SMALLER THAN THAT OF THE OUTLET FLOW PATH

BACKGROUND OF THE INVENTION

1. Field of the Invention

The present invention relates to a positive displacement pump which moves fluid by changing the volume of its pumping chamber with a piston or diaphragm, and, more particularly, it relates to a highly reliable pump with a high flow rate.

2. Description of the Related Art

Conventionally, typical pumps of this type have a check valve installed between an inlet flow path and a variable-volume pumping chamber as well as between an outlet flow path and the pumping chamber, as described, for example, in Japanese Patent Laid-Open No. 10-220357.

Also, there are pumps which produce unidirectional flow by utilizing viscous drag and are configured, for example, as described in Japanese Patent Laid-Open No. 08-312537 such that fluid resistance is larger in the inlet flow path than in the outlet flow path when a valve installed in the outlet flow path is open.

Furthermore, there are pumps which have compression components configured such that pressure drops vary with the flow direction both in inlet and outlet flow paths in order to improve the reliability of the pumps without using movable parts for valves, as described, for example, in National Publication of International Patent Application No. 08-506874 and in a paper "An improved valve-less pump fabricate using deep reactive ion etching" on pp. 479–484 of 1996 IEEE 9th International Workshop on Micro Electro Mechanical Systems.

However, the configuration described in Japanese Patent Laid-Open No. 10-220357 requires a check valve both in the inlet and outlet flow paths and has the problem that a fluid passing through two check valves suffers high pressure loss. Also, the check valves, which open and close repeatedly, are liable to fatigue damage. Besides, the larger the number of check valves, the lower the reliability.

Also, the configuration described in Japanese Patent Laid-Open No. 08-312537 needs to increase the fluid resistance in the inlet flow path in order to reduce back-flow in the inlet flow path during the discharge stroke of the pump. Consequently, the suction stroke of the pump, during which the fluid is introduced into the pumping chamber against the fluid resistance, becomes considerably longer than the discharge stroke. This results in a significantly low frequency of cycling between the pump's suction and discharge strokes. With a pump in which a piston or diaphragm moves up and down, generally the higher the frequency of the up-down movement, the higher the flow rate and power output, provided the area of the piston or diaphragm is constant. However, since the configuration described in Japanese Patent Laid-Open No.08-312537 allows only low-frequency operation as described above, it cannot implement a small, high-power pump.

Furthermore, in the case of the pump described in National Publication of International Patent Application No. 08-506874, since it is configured to produce unidirectional net flow of the fluid passing through the compression components as the volume of the pumping chamber increases and decreases, using the pressure drops which vary with the flow direction, the back-flow increases with increases in external pressure (load pressure) on the outlet side and the pump fails to operate under high load pressure. According to the paper"An improved valve-less pump fabricate using deep reactive ion etching," the maximum load pressure is around 0.760 atmosphere.

The present invention has been made to solve the prior art problems described above. Its object is to provide a small, lightweight, high-power pump which can operate even under high load pressure.

SUMMARY OF THE INVENTION

To achieve the above object, pumps according to the present invention are configured as follows.

A first pump according to the present invention comprises an actuator which displaces a movable wall such as a piston or diaphragm; a pumping chamber whose volume can be varied by the displacement of the movable wall; an inlet flow path through which a working fluid flows into the pumping chamber; and an outlet flow path through which the working fluid flows out of the pumping chamber, wherein the outlet flow path is in constant communication with the pumping chamber even when the pump is in operation, combined inertance value of the inlet flow path is smaller than combined inertance value of the outlet flow path, the inlet flow path is equipped with a fluid resistance element which makes the fluid resistance smaller when the working fluid flows into the pumping chamber than when the working fluid flows out, and are turn inlet is installed where the cross-sectional area of the outlet flow path is at least twice the cross-sectional area of the narrowest part of the flow path leading out of the pumping chamber of the pump.

Preferably, the first pump comprises an active valve which communicates the inlet flow path and outlet flow path of the pump through the return inlet.

Preferably, the first pump comprises an actuator made of shape-memory alloy to drive the active valve.

A second pump according to the present invention comprises an actuator which displaces a movable wall such as a piston or diaphragm; a pumping chamber whose volume can be varied by the displacement of the movable wall; a pressure chamber in communication with the pumping chamber via a connecting flow path; an inlet flow path through which a working fluid flows into the pressure chamber; and an outlet flow path through which the working fluid flows out of the pressure chamber, wherein the cross-sectional area of the connecting flow path is smaller than that of the pumping chamber, the outlet flow path is in constant communication with the pressure chamber even when the pump is in operation, combined inertance value of the inlet flow path is smaller than combined inertance value of the outlet flow path, and the inlet flow path is equipped with a fluid resistance element which makes the fluid resistance smaller when the working fluid flows into the pressure chamber than when the working fluid flows out.

Preferably, in the second pump, the connecting flow path is positioned right in front of the fluid resistance element.

Preferably, in the second pump, the outlet flow path is open in the flow direction of the working fluid flowing out of the fluid resistance element.

Preferably, in the second pump, the pumping chamber is filled with fluid, and the connecting flow path is equipped with a membrane capable of deformation equivalent to volume changes of the pumping chamber.

A third pump according to the present invention comprises an actuator which displaces a movable wall such as a piston or diaphragm; a pumping chamber whose volume can be varied by the displacement of the movable wall; an inlet flow path through which a working fluid flows into the pumping chamber; and an outlet flow path through which the working fluid flows out of the pumping chamber, wherein the inlet flow path is equipped with a fluid resistance element which makes the fluid resistance smaller when the working fluid flows into the pumping chamber than when the working fluid flows out, and the outlet flow path has such dimensions that the maximum kinetic energy stored in the outlet flow path during one cycle of pump operation is not less than ⅓ the energy consumed by flow path resistance until the maximum kinetic energy is stored.

Preferably, if inertance of the outlet flow path is denoted by L, if displaced volume when the movable wall is displaced from bottom dead center to top dead center is denoted by $V_0$, if the flow path resistance of the outlet flow path is denoted by R, and if flow velocity in the outlet flow path when the actuator produces one cycle of output energy is denoted by $Q_{(T)}$, the following formula is satisfied.

$$\frac{1}{2}LQ_{(T)}^2 \geq \frac{1}{3}\left(\frac{2}{3}Q_{(T)}V_0R\right)$$

A fourth pump according to the present invention comprises an actuator which displaces a movable wall such as a piston or diaphragm; a pumping chamber whose volume can be varied by the displacement of the movable wall; an inlet flow path through which a working fluid flows into the pumping chamber; and an outlet flow path through which the working fluid flows out of the pumping chamber, wherein the inlet flow path is equipped with a fluid resistance element which makes the fluid resistance smaller when the working fluid flows into the pumping chamber than when the working fluid flows out, and compliance of fluid in the outlet flow path is not more than three times the compliance of the actuator.

Preferably, in the fourth pump, the length of the outlet flow path is not less than ½ of average equivalent diameter.

Preferably, in the fourth pump, the length of the outlet flow path is 45 mm or less.

Preferably, in the fourth pump, the average diameter of the outlet flow path is 70 $\mu$m or more.

Preferably, in the fourth pump, the average diameter of the outlet flow path is 3 mm or less.

Preferably, the actuator in the first to fourth pump is a piezoelectric element.

Preferably, the actuator in the first to fourth pump is a giant magnetostrictive element.

DETAILED DESCRIPTION OF THE PREFERRED EMBODIMENTS

Embodiments of a pump according to the present invention will be described in detail below with reference to the drawings.

(1) First Embodiment

Figure 1:
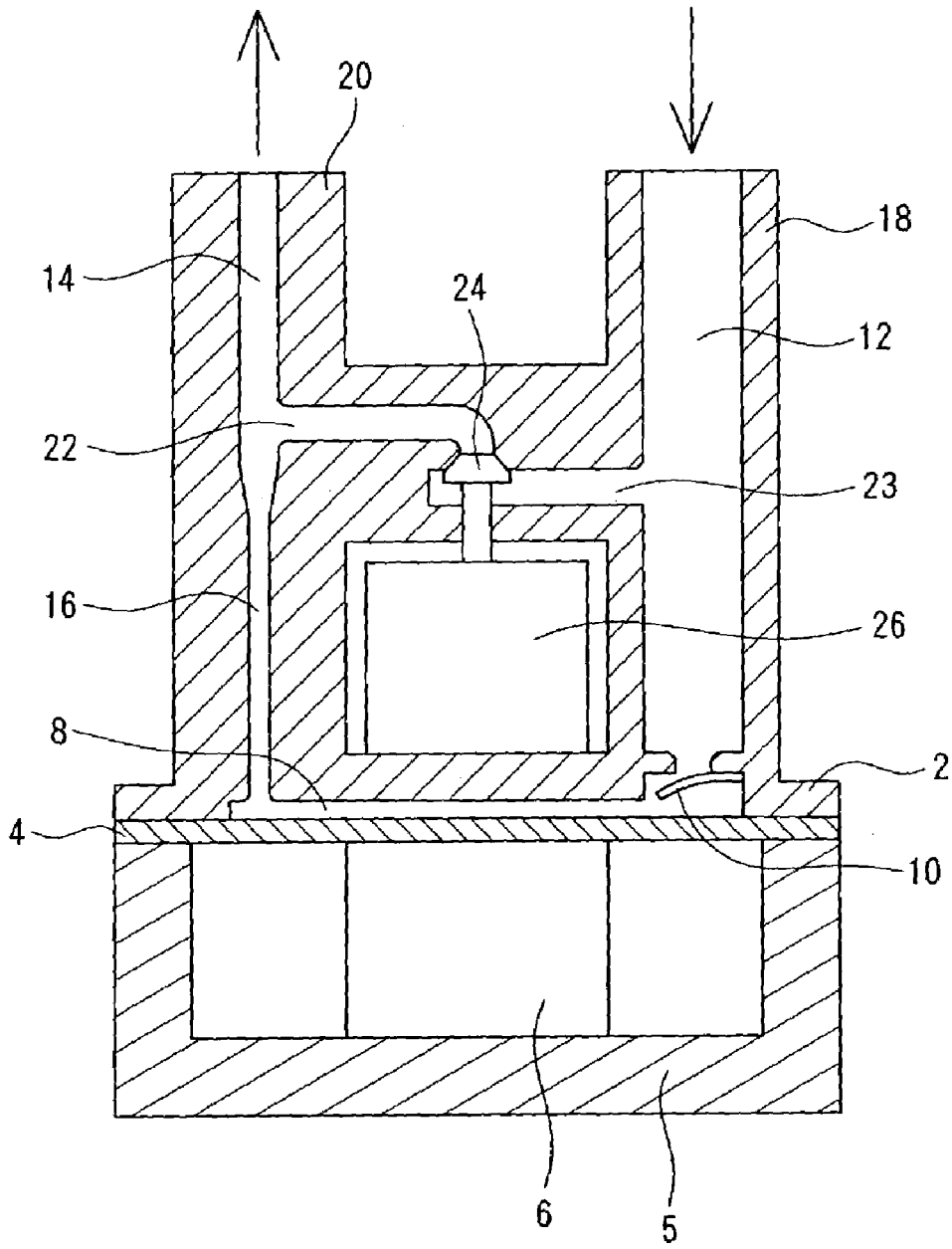
FIG. 1 is a diagram showing a longitudinal section of a pump according to a first embodiment of the present invention.

FIG. 1 is a diagram showing a longitudinal section of a pump according to a first embodiment of the present invention. In FIG. 1, a circular diaphragm 4 is placed at the bottom of a cylindrical casing 2. The diaphragm 4 is free to deform elastically with its rim supported rigidly by the casing 2. At the bottom of the diaphragm 4, a piezoelectric element 6 which expands and contracts in the vertical direction of the figure is installed in its own casing 5 as an actuator for moving the diaphragm 4.

A narrow space between the diaphragm 4 and the top wall of the casing 2 constitutes a pumping chamber 8. An inlet flow path 12 and an outlet flow path 14 are open to the pumping chamber 8, where in a check valve 10 serving as a fluid resistance element is installed in the inlet flow path 12. Immediately downstream of the pumping chamber 8, the outlet flow path 14 has a narrow segment 16. Part of the circumference of the inlet flow path 12 forms an inlet-side connecting pipe 18 to connect external piping (not shown) to the pump. Similarly, part of the circumference of the outlet flow path 14 forms an outlet-side connecting pipe 20 to connect external piping (not shown) to the pump.

The narrow segment 16 of the outlet flow path has ½ the diameter and ¼ the cross sectional area of the outlet flow path 14. The outlet flow path 14 has a return inlet 22, which is connected to a return outlet 23 in the inlet flow path via an active valve 24. The active valve 24 is opened and closed freely by an actuator 26 made of shape-memory alloy.

Next, operation of the pump according to this embodiment will be described with reference to FIG. 1.

During the pump's forward operation in which working fluid flows in the direction of the arrow, the active valve 24 is kept closed by the actuator 26 made of shape-memory alloy as shown in FIG. 1. When the diaphragm 4 operates in such a way as to reduce the volume of the pumping chamber 8, the working fluid is forced back in the inlet flow path 12, closing the check valve 10 and thus increasing fluid resistance. Consequently, little or no working fluid in the inlet flow path 12 flows out of the inlet flow path 12. On the other hand, in the outlet flow path 14 with its narrow segment 16, as the pressure in the pumping chamber 8 rises according to the compressibility of the working fluid, the flow rate of the flow out of the pumping chamber 8 increases according to the differential pressure between the pumping chamber pressure and load pressure according to inertance value.

When the diaphragm 4 operates in such a way as to increase the volume of the pumping chamber 8, the pressure in the pumping chamber 8 lowers. When the pressure in the pumping chamber 8 lowers below external pressure in the inlet flow path 12, the working fluid flows forward in the inlet flow path 12, opening the check valve 10 and thus reducing fluid resistance. Consequently, the flow rate of the flow into the pumping chamber 8 increases according to the differential pressure and the inertance value of the inlet flow path 12. On the other hand, in the outlet flow path 14 with its narrow segment 16, the flow rate of the flow out of the pumping chamber 8 lowers according to the differential pressure between the load pressure and pumping chamber pressure according to inertance value.

Working fluid equal in volume to the working fluid which flows out of the pumping chamber 8 is fed into the pumping chamber 8. If this is done when the rate of increase in the rate of inflow into the inlet flow path 12 is large, this can be done when decreases in the rate of outflow from the outlet flow path 14 with its narrow segment 16 are still small accordingly. Thus, it is advisable to make the combined inertance value of the inlet flow path 12 smaller than that of the outlet flow path 14 with its narrow segment 16 as in the case of this embodiment. The narrow segment 16 of the outlet flow path has a small cross-sectional area and has a large inertance value, which is given by $L=\rho l/S$.

On the other hand, working fluid has high flow velocity where there is a small cross-sectional area because of its continuity. When the active valve 24 is kept closed by the actuator 26 made of shape-memory alloy, the energy loss from the return inlet 22, which corresponds to a branch of a blind pipe, is proportional to the square of the velocity. Consequently, according to this embodiment, since the return inlet 22 is installed in the part of the outlet flow path 14 which is located downstream of the narrow segment 16 and where the cross-sectional area is four times that of the narrow segment 16 and the flow velocity is ¼, the energy loss can be reduced to 1/16 the energy loss which would occur if the return inlet were installed in the narrow segment 16 of the outlet flow path 14. Thus, by installing the return inlet 22 in that part of the outlet flow path 14 whose cross-sectional area is at least twice the cross-sectional area of the narrowest part of the flow path leading out of the pumping chamber of the pump, energy loss across the location of the return inlet 22 can be reduced to ¼, resulting in a highly efficient pump.

Using the above configuration, a small, lightweight, high-power pump can be implemented by reducing the number of fluid resistance elements such as the check valve 10 and thus reducing pressure loss. Furthermore, since only one fluid resistance element (check valve 10) is installed, the fluid actuator will not self-reset when the pump stops if the fluid actuator equipped with a self-resetting capability remains stationary.

Figure 2:
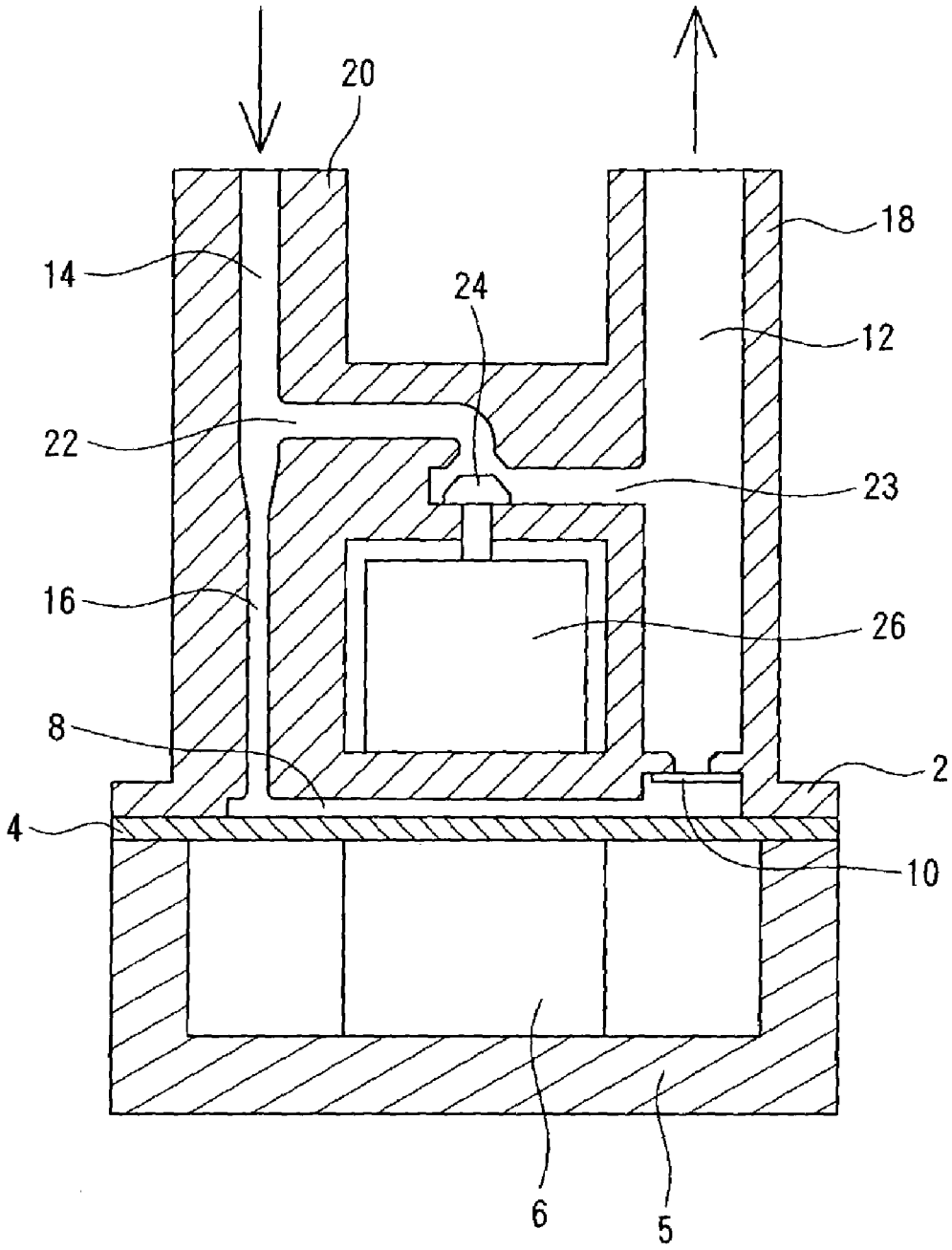
FIG. 2 is a diagram showing a longitudinal section of the pump according to the first embodiment of the present invention during reverse operation.

Next, reverse operation of the pump according to this invention will be described with reference to FIG. 2. FIG. 2 is a diagram showing a longitudinal section of the pump according to this embodiment during reverse operation.

First the diaphragm 4 of the pump is stopped and the active valve 24 is opened by the actuator 26 made of shape-memory alloy as shown in FIG. 2. When the fluid actuator equipped with a self-resetting capability is connected to external piping (not shown) connected to the outlet-side connecting pipe 20, the pressure in the outlet flow path 14 becomes higher than the pressure in the inlet flow path 12 because of the self-resetting capability. Thus, the working fluid flows backward from the return inlet 22, through the active valve 24 and the return outlet 23, to the inlet flow path 12. Consequently, the fluid actuator resets, allowing bidirectional operation.

Furthermore, the actuator 26 made of shape-memory alloy which drives the active valve 24 can achieve a large amount of displacement with great force in spite of low operating speed. Besides, it is best suited to driving an active valve because of its simple structure.

As described above, the pump according to this embodiment needs the check valve 10 to be installed only in the inlet flow path 12, meaning that the pressure loss caused by the check valve 10 in the interval between the inlet flow path 12 and outlet flow path 14 can be reduced. Also, it can reduce the pressure loss in the return inlet 22. Consequently, it can achieve small size, light weight, and high power. Besides, the pump is equipped with the active valve 24 operated by the actuator 26 made of shape-memory alloy. If this mechanism is used in conjunction with a fluid actuator equipped with a self-resetting capability, the pump according to this embodiment can achieve bidirectional operation.

Incidentally, this mechanism can be used not only for a fluid actuator equipped with a self-resetting capability, but also for various flow paths in which working fluid needs to flow bidirectionally.

(2) Second Embodiment

Figure 3:
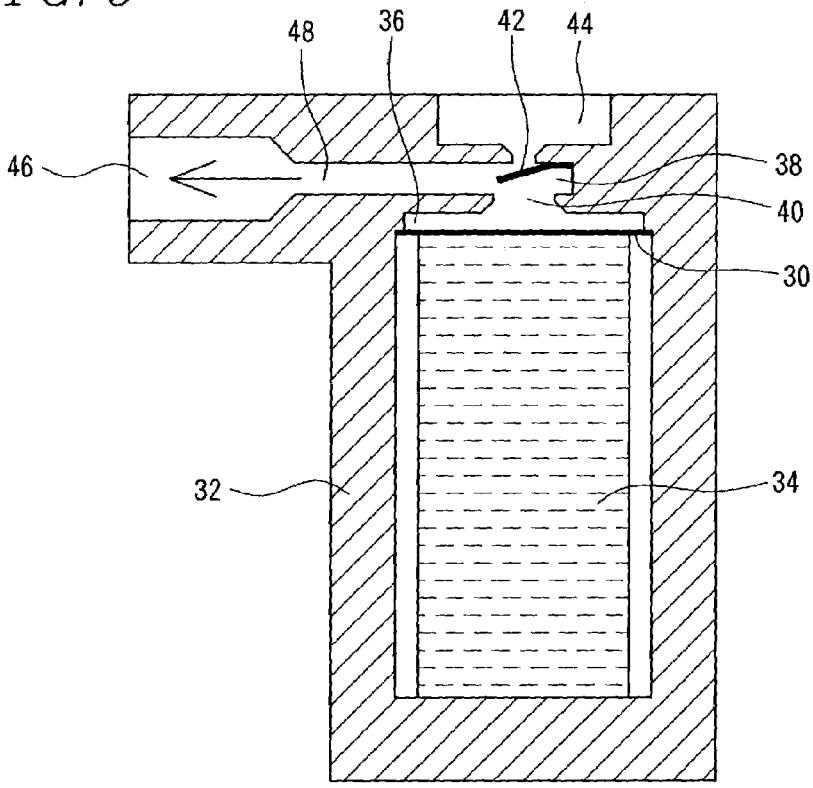
FIG. 3 is a diagram showing a longitudinal section of a pump according to a second embodiment of the present invention.

FIG. 3 is a diagram showing a longitudinal section of a pump according to a second embodiment of the present invention. In FIG. 3, a diaphragm 30 is free to deform elastically with its rim supported rigidly by a casing 32. At the bottom of the diaphragm 30, a piezoelectric element 34 which expands and contracts in the vertical direction of the figure is installed as an actuator for moving the diaphragm 30.

A pumping chamber 36 is formed between the diaphragm 30 and casing 32. The pumping chamber 36 is in communication with a pressure chamber 38 via a connecting flow path 40 which is smaller in cross-sectional area than the pumping chamber 36. The pressure chamber 38 is in communication with an inlet flow path 44 and an outlet flow path 46, wherein a check valve 42 serving as a fluid resistance element is installed in the inlet flow path 44. The check valve 42 is positioned right in front of the connecting flow path 40 which communicates the pumping chamber 36 and pressure chamber 38 with each other. The outlet flow path 46 is open in the flow direction of the working fluid flowing out of the check valve 42. The flow direction here means the direction in which the check valve 42 opens. The outlet flow path 46 includes a narrow segment 48 which is located downstream of the pressure chamber 38 and has a small cross-sectional area.

Next, operation of the pump according to this embodiment will be described with reference to FIG. 3. The arrow in the figure indicates the direction in which the working fluid is discharged from the pump according to this embodiment.

First, when the diaphragm 30 operates in such a way as to reduce the volume of the pumping chamber 36, the working fluid in the pumping chamber 36 moves to the pressure chamber 38 via the connecting flow path 40. As a result, the pressure in the pressure chamber 38 rises, the working fluid is forced back in the inlet flow path 44, closing the check valve 42 and thus increasing fluid resistance. Consequently, little or no working fluid flows in from the inlet flow path 44. On the other hand, in the outlet flow path 46 with its narrow segment 46, as the pressure in the pressure chamber 38 rises according to the compressibility of the working fluid, the flow rate of the flow out of the pumping chamber 36 increases according to the differential pressure between the pressure chamber pressure and load pressure as well as to inertance value.

Next, when the diaphragm 30 operates in such a way as to increase the volume of the pumping chamber 36, the working fluid in the pressure chamber 38 moves to the pumping chamber 36. As a result, the pressure in the pressure chamber 38 lowers. When the pressure in the pressure chamber 38 lowers below external pressure in the inlet flow path 44, the working fluid flows forward in the inlet flow path 44, opening the check valve 42 and thus reducing fluid resistance. Consequently, the flow rate of the flow into the pressure chamber 38 increases according to the differential pressure and the inertance value of the inlet flow path 44. On the other hand, in the outlet flow path 46 with its narrow segment 48, the flow rate of the flow out of the pressure chamber 38 lowers according to the differential pressure between the load pressure and the pressure in the pressure chamber 38 as well as to inertance value.

Working fluid equal in volume to the working fluid which flows out of the pressure chamber 38 is fed into the pumping chamber 36. If this is done when the rate of increase in the rate of inflow into the inlet flow path 44 is large, this can be done when decreases in the rate of outflow from the outlet flow path 46 with its narrow segment 48 are still small accordingly. In this state, since the working fluid flows directly from the inlet flow path 44 into the outlet flow path 46 with its narrow segment 48 via the pressure chamber 38, a larger volume can be delivered than the volume change of the pumping chamber 36 caused by deformation of the diaphragm 30.

To enhance this effect, it is advisable to make the combined inertance value of the inlet flow path 44 smaller than that of the outlet flow path 46 with its narrow segment 48 as in the case of this embodiment. The narrow segment 48 of the outlet flow path has a small cross-sectional area and has a large inertance value, which is given by $L=\rho l/S$.

Furthermore, according to this embodiment, the outlet flow path 46, which is open in the flow direction of the working fluid flowing out of the check valve 42, offers small fluid resistance against the working fluid, resulting in further increase in the flow rate.

When the piezoelectric element 34 is used to drive the pump, due to its small amount of displacement the cross-sectional area of the diaphragm 30 or piston must be increased. However, when the pressure in the pumping chamber 36 is increased, the working fluid itself is compressed, decreasing volumetric efficiency of the pump. A solution to this involves decreasing the thickness of the pumping chamber to decrease the volume of the pumping chamber, but if the inlet flow path and outlet flow path are open to the pumping chamber directly, the narrowed pumping chamber, which serves as a flow path, will increase the fluid resistance.

According to this embodiment, the pressure chamber 38 is not constrained by the cross-sectional area of the diaphragm 30 or piston unlike the pumping chamber 36. Also, the connecting flow path 40 leading out of the pumping chamber 36 is smaller than the pumping chamber in cross-sectional area. Consequently, the connecting flow path 40 can be made into such a shape that has small flow path resistance without increasing its volume, resulting in reduced energy loss.

Using the above configuration, a small, lightweight, high-power pump can be implemented by reducing the number of fluid resistance elements such as the check valve 42 and thus reducing pressure loss.

Furthermore, according to this embodiment, since the check valve 42 which is a fluid resistance element is positioned right in front of the flow path which communicates the pumping chamber 36 and pressure chamber 38 with each other, when the diaphragm 30 operates in such a way as to reduce the volume of the pumping chamber 36, the working fluid flowing from the pumping chamber 36 to the pressure chamber 38 generates flow in the pressure chamber 38 and the pressure created by this flow acts to close the check valve 42. Consequently, the check valve 42 closes quickly. This makes it possible to provide a highly efficient, high-power pump with little back-flow even under high-pressure loading.

(3) Third Embodiment

Next, a third embodiment of the present invention will be described with reference to FIG. 4.

Figure 4:
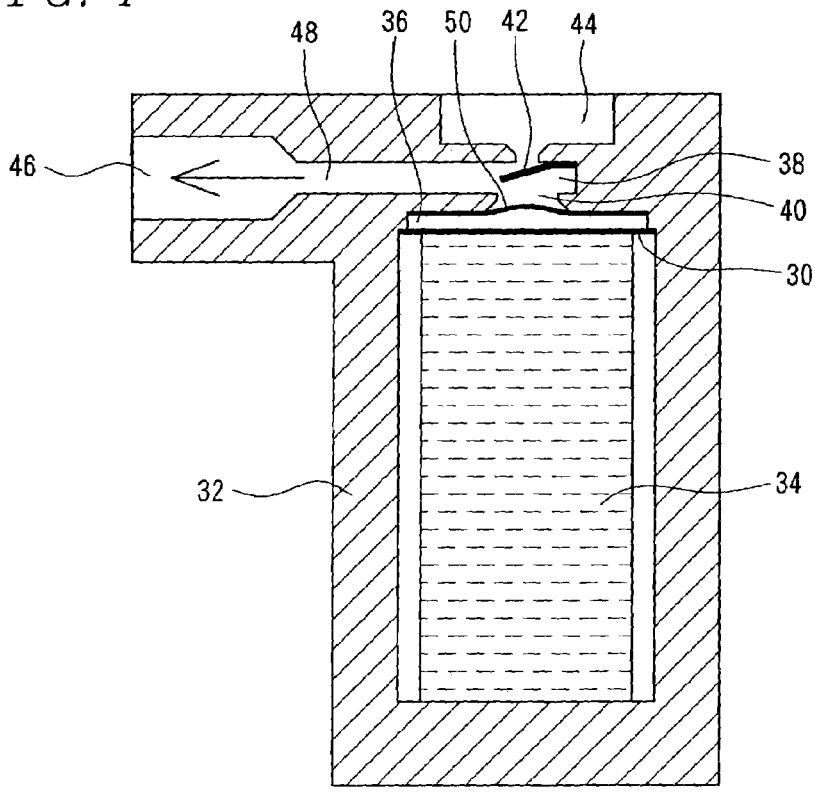
FIG. 4 is a diagram showing a longitudinal section of a pump according to a third embodiment of the present invention.

The basic configuration in FIG. 4 is similar to that of the second embodiment, but the pumping chamber 36 is filled with fluid and a membrane 50 made of a thin resin film is fixed to the connecting flow path 40. The membrane 50 is capable of deformation equivalent to volume changes of the pumping chamber 36 and has little effect on subtle movements of the working fluid in the connecting flow path 40. For example, even if the connecting flow path 40 has a cross-sectional area 1/10 that of the pumping chamber 36, since the amount of expansion/contraction of the piezoelectric element 34 is a few microns, the amount of movement of the working fluid in the connecting flow path 40 is on the order of 10 $\mu$m. Consequently, in a small flow of working fluid produced by a piezoelectric element or the like, this is equivalent to a configuration in which the pumping chamber 36 and pressure chamber are in communication with each other via the connecting flow path 40. Thus, the operation is quite similar to that of the second embodiment.

According to this embodiment, even if gaseous components contained in the working fluid form bubbles in the flow paths, since the working fluid does not pass through the pumping chamber 36 with many corners, the bubbles are discharged efficiently together with the working fluid. If bubbles were accumulated in the pumping chamber 36, volume changes in the pumping chamber 36 would not lead to sufficient pressure build-up due to compressibility of the gas, resulting in reduced power. According to this embodiment, however, since the pumping chamber 36 is isolated from the working fluid, bubbles which would cause pressure loss are not produced in the pumping chamber 36. Besides, since the liquid in the pumping chamber 36 does not need to be the same as the working fluid, a liquid with small compressibility and with low gas contents can be enclosed in the pumping chamber 36.

The membrane 50, to which the same pressure is applied from both sides, does not need to have high tensile strength. Thus, even a thin material can secure high rigidity in the thickness direction, resulting in reduced pressure loss. A metal bellows may also be used.

As described above, the pump according to this embodiment needs the check valve 42 to be installed only in the inlet flow path 44, meaning that the pressure loss caused by the check valve 42 in the interval between the inlet flow path 44 and outlet flow path 46 can be reduced. Also, it allows the use of flow paths with reduced fluid resistance. Consequently, it can achieve small size, light weight, and high power.

(4) Fourth Embodiment

Next, a fourth embodiment of the present invention will be described.

Figure 5:
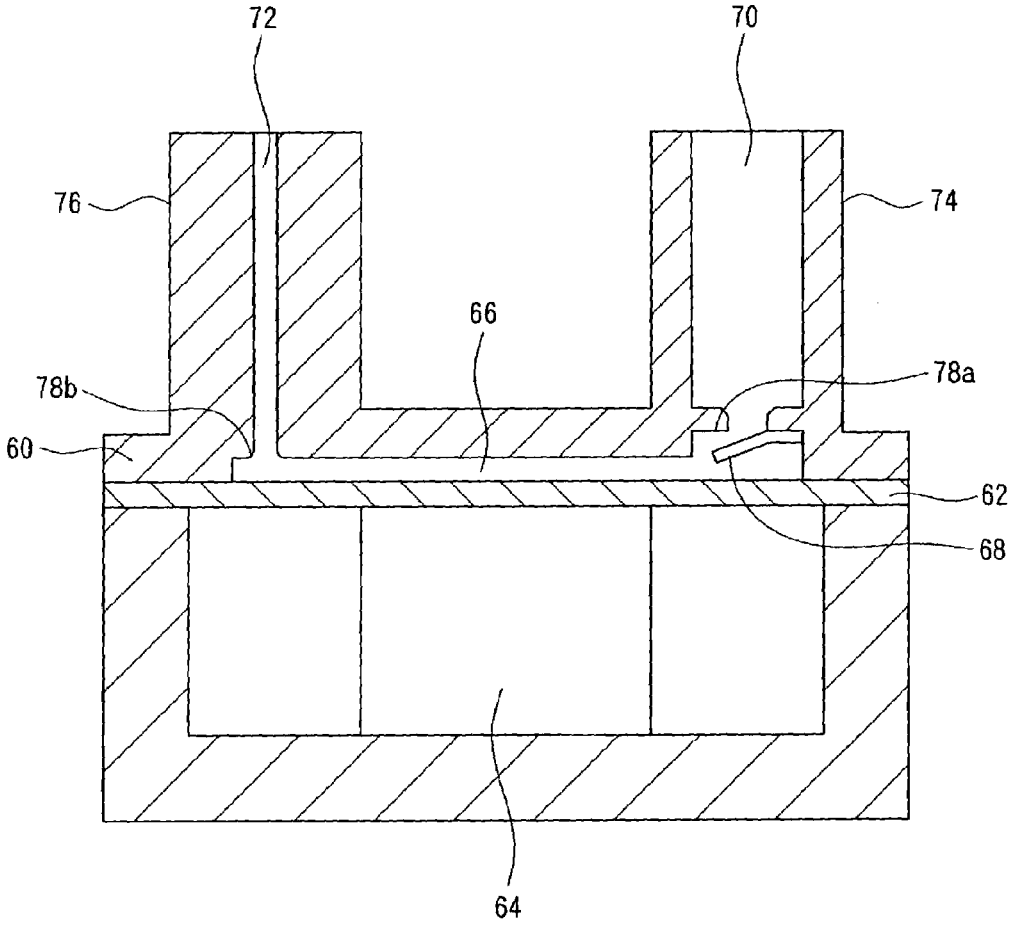
FIG. 5 is a diagram showing a longitudinal section of a pump structure according to a fourth embodiment of the present invention.

FIG. 5 shows a longitudinal section of a pump according to this embodiment, wherein a diaphragm 62 is installed at the bottom of a cylindrical casing 60. The diaphragm 62 is free to deform elastically with its rim supported rigidly by the casing 60. At the bottom of the diaphragm 62, a piezoelectric element 64 which expands and contracts in the vertical direction of the figure is installed as an actuator for moving the diaphragm 62.

A narrow space between the diaphragm 62 and the upper wall of the casing 60 constitutes a pumping chamber 66. An inlet flow path 70 and an outlet flow path 72 are open to the pumping chamber 66, wherein a check valve 68 serving as a fluid resistance element is installed in the inlet flow path 70 and the outlet flow path 72 has a small bore constantly opening to the pumping chamber 66 even when the pump is in operation. Part of the circumference of the inlet flow path 70 forms an inlet-side connecting pipe 74 to connect external piping (not shown) to the pump. Similarly, part of the circumference of the outlet flow path 72 forms an outlet-side connecting pipe 76 to connect external piping (not shown) to the pump. Both inlet flow path 70 and outlet flow path 72 have rounded portions 78*a* and 78*b*, respectively, at the inner end. The external piping is made of silicone rubber, rubber-based material, other resin, thin metal, or the like which deforms easily under the pressure in the piping.

Now, inertance L will be defined. It is given by $L=\rho\times l/S$, where S is the cross-sectional area of a given flow path, l is the length of the flow path, and ρ is the density of the working fluid. If the differential pressure of the flow path is denoted by ΔP and the flow rate along the flow path is denoted by Q, then by transforming the kinetic equation of the fluid in the flow path, the relationship $\Delta P=L\times dQ/dt$ can be derived.

In other words, inertance L represents the effect of pressure on time variation of the flow rate. The larger the inertance L, the smaller the time variation of the flow rate. The smaller the inertance L, the larger the time variation of the flow rate.

To calculate combined inertance value of flow paths connected in parallel or flow paths of different shapes connected in series, the inertance of individual flow paths can be combined as is the case with parallel connection or serial connection of inductance in an electrical circuit.

The inlet flow path 70 here means the flow path from the pumping chamber 66 to the inlet end of the inlet-side connecting pipe 74. However, if pulsation damping means is installed midway along the line, the term means the flow path from the pumping chamber 66 to the connection with the pulsation damping means. If a plurality of inlet flow paths 70 join, the term means the flow path from the pumping chamber 66 to the juncture. The same applies to the outlet flow path 72.

Regarding the inlet flow path 70 and outlet flow path 72, relationship between their lengths and areas will be described using symbols with reference to FIG. 5. Concerning the inlet flow path 70, let L1 denote the length of a throat near the check valve 68, let S1 denote its area, let L2 denote the length of the remaining wide portion, and let S2 denote its area. Concerning the outlet flow path 72, let L3 denote its length and S3 denote its area.

The inertance of the inlet flow path 70 and outlet flow path 72 will be described using the above symbols and the density ρ of the working fluid.

The inertance of the inlet flow path 70 is given by $\rho\times L1/S1+\rho\times L2/S2$. On the other hand, the inertance of the outlet flow path is given by $\rho\times L3/S3$. These flow paths satisfy the relationship $\rho\times L1/S1+\rho\times L2/S2<\rho\times L3/S3$.

In the above configuration, the shape of the diaphragm 62 is not limited to circular shapes. Even if a valve element is installed in the outlet flow path 72, for example, to protect pump components from excessive load pressure which may be applied when the pump stops, there is no problem if the outlet flow path 72 is opened to the pumping chamber 66 at least when the pump is in operation. Also, the check valve 68 is not limited to the type which opens and closes by differential pressure of fluid. It may be of a type that uses other power than the differential pressure of fluid to control the opening and closing of the valve.

The actuator for driving the diaphragm 62 may be of any type as long as it expands and contracts. However, in the pump structure according to this embodiment, the actuator and diaphragm 62 are connected directly without a displacement magnification mechanism and the diaphragm 62 can be driven at high frequencies. Consequently, by using the piezoelectric element 64 which has a high response frequency and produces high power per unit volume as is the case with this embodiment, it is possible to increase the flow rate as well as the energy stored in the fluid in the outlet flow path by means of high-frequency driving. This makes it possible to implement a small, high-power pump. A giant magnetostrictive element may be used for the same reason.

Besides, a mechanical valve needs to be installed only on the suction side, making it possible to limit the amount of reduction in flow rate and increase reliability.

Next, description will be given of internal state of the pump according to this embodiment when deaerated pure water is used as the working fluid.

Figure 6:
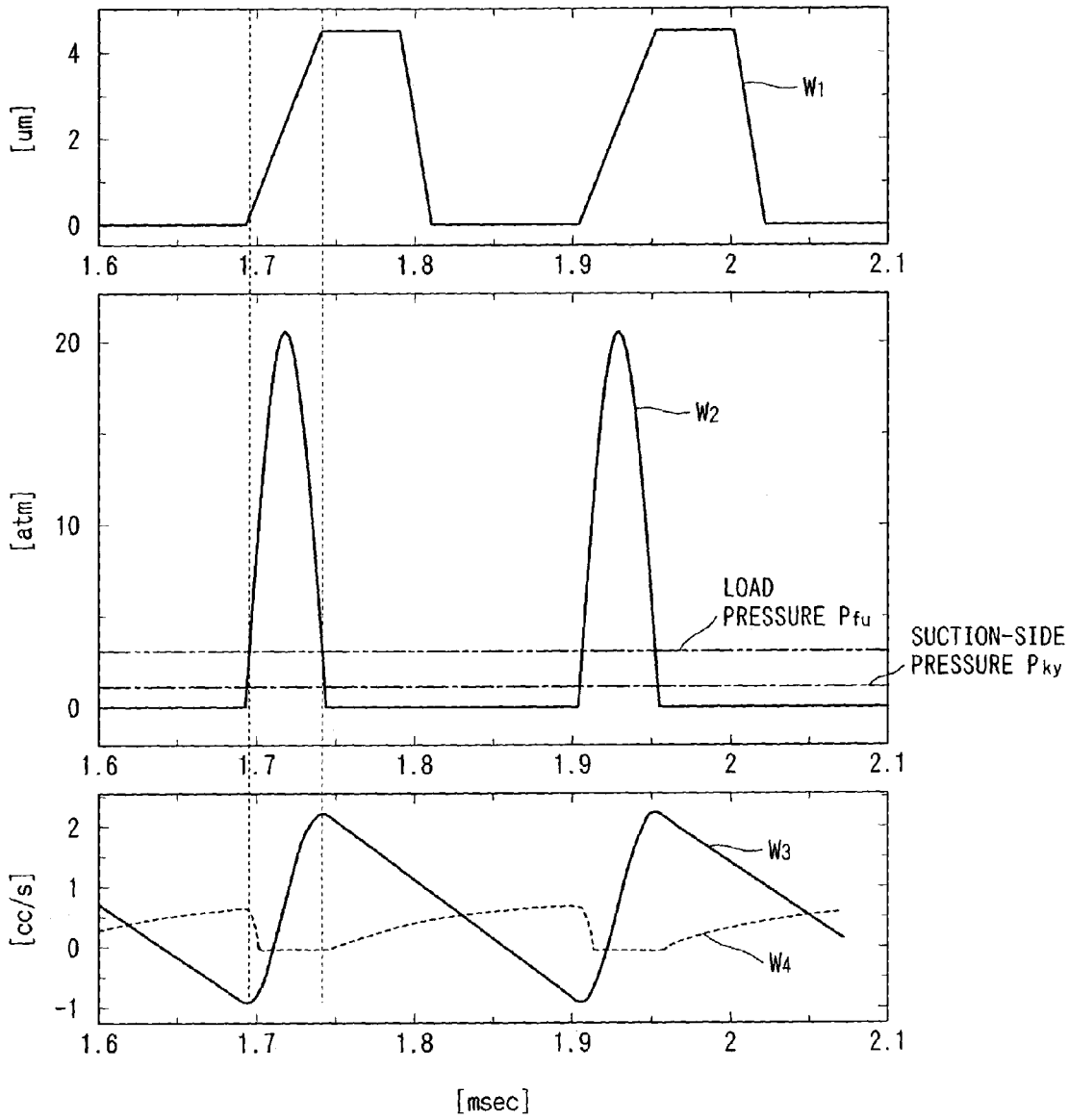
FIG. 6 is a diagram showing state quantities during operation of the pump according to the fourth embodiment.

FIG. 6 shows a waveform W1 of the displacement of the diaphragm 62, a waveform W2 of the internal pressure of the pumping chamber 66, a waveform W3 of the volume velocity (cross-sectional area of the output flow path×flow velocity of the fluid: equal to the flow rate) of the fluid passing through the outlet flow path 72, and a wave form W4 of the volume velocity of the fluid passing through the check valve 68 when the pump is operated. Also, in FIG. 6, load pressure $P_{fu}$ is the fluid pressure downstream of the outlet flow path 72 while suction-side pressure $P_{ky}$ is the fluid pressure upstream of the inlet flow path 70.

As shown by the waveform W1 of the displacement of the diaphragm 62, the region in which the slope of the waveform is positive represents the process in which the piezoelectric element 64 expands reducing the volume of the pumping chamber 66. On the other hand, the region in which the slope of the waveform is negative represents the process in which the piezoelectric element 64 contracts increasing the volume of the pumping chamber 66.

The flat segments of the waveform displaced by 4.5 μm represent the displaced position (top dead center) of the diaphragm 62 where the volume of the pumping chamber 66 becomes a minimum due to displacement of the piezoelectric element 64.

As shown by the waveform W2 of the internal pressure of the pumping chamber 66, when the process of reducing the pumping chamber 66 volume is started, the internal pressure of the pumping chamber 66 starts to increase. Before the process of reducing the pumping chamber 66 volume ends, the internal pressure of the pumping chamber 66 reaches the maximum value and starts to decline. The point at which the internal pressure reaches the maximum value coincides with the point at which the volume velocity of the fluid displaced by the diaphragm 62 equals the volume velocity of the fluid passing through the outlet flow path 72 represented by the waveform W3.

The reason is as follows: Before this time point, the relationship "the volume velocity of the displaced fluid—the volume velocity of the fluid passing through the outlet flow path 72>0" holds, and thus the fluid in the pumping chamber 66 is compressed accordingly, increasing the pressure of the pumping chamber 66 whereas after this time point, the relationship "the volume velocity of the displaced fluid—the volume velocity of the fluid passing through the outlet flow path 72<0" holds and thus the fluid in the pumping chamber 66 is decompressed accordingly, decreasing the pressure of the pumping chamber.

If the volume change of the fluid in the pumping chamber 66 is denoted by ΔV, the following relationship holds:

> "$\Delta V$=volume of fluid displaced by diaphragm 62+volume of sucked fluid—volume of discharged fluid"

This means that the pressure in the pumping chamber 66 changes according to ΔV and compressibility of the fluid. Thus, even if the volume of the pumping chamber 66 is in the process of decline, there may be cases in which the pumping chamber 66 pressure lowers below the load pressure $P_{fu}$. However, if such a sharp displacement that the piezoelectric element 64 reaches the top dead center while the volume of sucked fluid is zero takes place, the internal pressure of the pumping chamber 66 remains higher than the load pressure $P_{fu}$ until the volume of the fluid displaced by the diaphragm 62 equals the volume of the discharged fluid. All that while, the fluid in the outlet flow path 72 increases its velocity.

Furthermore, in FIG. 6, when the pressure in the pumping chamber 66 lowers below the suction-side pressure $P_{ky}$ and nears zero at absolute pressure, aeration or cavitation occurs in which components dissolved in the working fluid forms bubbles, having reached saturation near zero at absolute pressure. However, if the entire fluid flow system including the pump is pressurized and the suction-side pressure $P_{ky}$ is sufficiently high, aeration or cavitation may not occur.

Also, as shown by the waveform W3 of the volume velocity of the fluid in the outlet flow path 72, the period during which the pressure in the pumping chamber 66 is higher than the load pressure $P_{fu}$, is approximately equal to the period during which the volume velocity of the fluid in the outlet flow path 72 increases. When the pressure in the pumping chamber 66 lowers below the load pressure $P_{fu}$, the volume velocity of the fluid in the outlet flow path 72 starts to decrease as well.

If $\Delta P_{out}$ denotes the differential pressure between the pressure in the pumping chamber 66 and load pressure $P_{fu}$, $R_{out}$ denotes fluid resistance in the outlet flow path 72, $L_{out}$ denotes inertance, and $Q_{out}$ denotes the volume velocity of the fluid, then the fluid in the outlet flow path 72 satisfies the following equation.

$$\Delta P_{out} = R_{out} Q_{out} + L_{out} \frac{dQ_{out}}{dt} \tag{1}$$

Thus, the rate of change of the volume velocity of the fluid is equal to $\Delta P_{out}$ minus $R_{out} \times Q_{out}$, all divided by inertance $L_{out}$. The value obtained by integrating the volume velocity of the fluid represented by one cycle of the wave form W3 equals the volume of discharged fluid per cycle.

Also, in the inlet flow path 70, as shown by the waveform W4 of the volume velocity change of the fluid passing through the check valve 68, when the pressure in the pumping chamber 66lowers below the suction-side pressure $P_{ky}$, the differential pressure opens the check valve 68, increasing the volume velocity of the fluid. On the other hand, when the pressure in the pumping chamber 66 rises above the suction-side pressure $P_{ky}$, the volume velocity of the fluid starts to fall. The effect of the check valve 68 prevents back-flow.

If $\Delta P_{in}$ denotes differential pressure between the pumping chamber 66 and suction-side pressure $P_{ky}$, $R_{in}$ denotes fluid resistance in the outlet flow path 72, $L_{in}$ denotes inertance, and $Q_{in}$ denotes the volume velocity of the fluid, then the fluid in the inlet flow path 70 satisfies the following equation.

$$\Delta P_{in} = R_{in} Q_{in} + L_{in} \frac{dQ_{in}}{dt} \tag{2}$$

Thus, again the rate of change of the volume velocity of the fluid is equal to $\Delta P_{in}$ minus $R_{in} \times Q_{in}$, all divided by the inertance $L_{in}$ of the inlet flow path 70.

The value obtained by integrating the volume velocity of the fluid represented by one cycle of the wave form W4 equals the volume of sucked fluid per cycle. This volume of sucked fluid is equal to the volume of discharged fluid represented by the waveform W3.

In the pump structure according to this embodiment, since the inertance of the inlet flow path 70 has been made smaller than that of the outlet flow path 72, the fluid in the inlet flow path 70 flows in at a higher rate of change in the volume velocity, increasing the volume of sucked fluid (=volume of discharged fluid).

As described above, the pump according to this embodiment is characterized in that the larger the kinetic energy of the fluid in the outlet flow path 72, the larger the volume of discharged fluid and thus the pump output power. Therefore, to increase the operating efficiency of the pump, it is important to convert the energy outputted by the piezoelectric element 64 efficiently into kinetic energy of the fluid in the outlet flow path 72. Also, it is important to extract as much energy as possible from the piezoelectric element 64 as output energy in downsizing the piezoelectric element 64.

Next, description will be given of relationship among various types of energy.

The output energy of the piezoelectric element up to time t is computed as the sum of the kinetic energy of the fluid in the outlet flow path and the energy lost due to fluid resistance up to that time t. Let T denote the time required by the diaphragm to cause displacement from bottom dead center to top dead center and let $V_0$ denote the volume displaced by the displacement of the diaphragm. Also, since the piezoelectric element is moved from bottom dead center to top dead center, one cycle of output energy Emax is produced.

If L denotes the inertance of the outlet flow path, R denotes fluid resistance derived from the Hagen-Poiseuille equation when the flow in the outlet flow path is laminar, and Q denotes the flow rate, then the energy equation concerned is given as $$E_{max} = \frac{1}{2}LQ^2 + \int_0^T RQ^2\,dt \tag{3}$$

If d denotes the diameter of the outlet flow path, l denotes the length of the outlet flow path, and ρ denotes the density of the working fluid, and ν denotes the viscosity the following equation holds.

$$\text{Inertance } L = \rho\frac{l}{\pi\left(\frac{d}{2}\right)^2}$$

Fluid resistance $$R = \frac{128\nu\rho l}{\pi d^4}$$

Both inertance and fluid resistance are expressed as a function of the diameter d and length l of the outlet flow path 72. Also, if E denotes the energy possessed which depends on the material and dimensions of the piezoelectric element, C denotes the compliance of the outlet flow path, and Cpzt denotes the compliance of the piezoelectric element, then Emax is given by $$E_{max} = E\frac{1}{\left(\frac{C}{C_{pzt}} + 1\right)}$$

If d denotes the diameter of the outlet flow path, l denotes the length of the outlet flow path, and β denotes the compressibility of the fluid, then the following relationship can be used, for the reasons described later.

Compliance of outlet flow path $$C = \beta\pi\left(\frac{d}{2}\right)^2 l$$

Again, the compliance is expressed as a function of the diameter d and length l of the outlet flow path.

On the other hand, when the piezoelectric element 64 causes displacement from bottom dead center to top dead center, producing the displaced volume $V_0$, since the suction valve remains closed, the pressure in the pumping chamber 66 remains higher than the load pressure until the volume of fluid discharged from the outlet flow path 72 becomes equal to the displaced volume $V_0$. Consequently, the volume velocity of the fluid in the outlet flow path increases monotonously. Thus, if the flow velocity in the outlet flow path when the piezoelectric element produces one cycle of output energy Emax is denoted by $Q_{(T)}$, the flow rate Q can be approximated by a linear function of time as follows:

$$Q = \frac{Q_{(T)}}{T}t$$

Since the integral of the flow rate Q up to time T is equal to the displaced volume $V_0$, the following equation holds.

$$T = \frac{2V_0}{Q_{(T)}} \tag{4}$$

Now, substituting Equation 4 into Equation 3, the following equation is obtained.

$$E_{max} = \frac{1}{2}LQ_{(T)}^2 + \frac{2}{3}Q_{(T)}V_0R \tag{5}$$

If the diameter d and length l of the outlet flow path 72, the energy possessed by the piezoelectric element 64 used, and the compliance Cpzt are known in Equation 5, $Q_{(T)}$ can be determined using a value other than $Q_{(T)}$ as a constant. Using $Q_{(T)}$, the kinetic energy stored in the fluid in the outlet flow path 72 (the same as the energy stored in the inertance of the outlet flow path described below) can be calculated as follows:

$$\frac{1}{2}LQ_{(T)}^2$$

Also, the energy consumed by resistance can be calculated as follows:

$$\frac{2}{3}Q_{(T)}V_0R$$

Comparing the energy stored in the inertance of the outlet flow path 72 and the energy consumed by resistance calculated above, if the diameter d and length l of the outlet flow path 72 are determined such that "the energy stored in the inertance of the outlet flow path>⅓×the energy consumed by resistance," 25% or more of the output energy of the piezoelectric element 64 can be stored in the inertance of the outlet flow path. More preferably, if the diameter d and length l of the discharge pipe are determined such that "the energy stored in the inertance of the outlet flow path>the energy consumed by resistance, " 50% or more of the output energy of the piezoelectric element 64 can be stored in the inertance of the outlet flow path. More preferably, if the diameter d and length l of the discharge pipe are determined such that "the energy stored in the inertance of the outlet flow path>3×the energy consumed by resistance," 75% or more of the output energy of the piezoelectric element 64 can be stored in the inertance of the outlet flow path.

When energy is applied from outside, the actuator such as the piezoelectric element 64 used by the pump of this embodiment or a giant magnetostrictive element has the maximum generated force when the displacement is zero. When the generated force is zero, the displacement reaches its maximum. Thus, the energy possessed by the actuator is given by the maximum generated force×the maximum displacement. On the other hand, if the piezoelectric element 64 is equipped with a compliant element, generated force does not increase easily when the amount of displacement is small. Consequently, the output energy Emax of the piezoelectric element 64 lowers greatly. With the pump according to this embodiment, no matter how rigid the pump may be made, fluid compliance exists. Especially, fluid compliance in the outlet flow path never ceases to exist. Therefore, if E denotes the energy possessed which depends on the dimensions of the piezoelectric element, C denotes the compliance of the outlet flow path, and Cpzt denotes the compliance of the piezoelectric element, then Emax has the value determined by the following equation at the most.

$$E_{\max} = E\frac{1}{\left(\frac{C}{C_{pzt}}+1\right)} \tag{6}$$

Now, if d denotes the diameter of the outlet flow path, I denotes the length of the outlet flow path, and β denotes the compressibility of the fluid, then the following relationship holds.

Compliance of outlet flow path $$C = \beta\pi\left(\frac{d}{2}\right)^2 l$$

Thus, by making at least the compliance of the fluid in the outlet flow path 72 not more than three times the compliance of the piezoelectric element 64 which acts as an actuator, approximately 25% of the energy possessed by the piezoelectric element 64 can be extracted. Furthermore, by making the compliance of the fluid in the pump including the outlet flow path 72 and pumping chamber 66 not more than three times the piezoelectric element 64, not less than approximately 25% of the energy possessed by the piezoelectric element 64 can be extracted.

Preferably, by making the compliance of the fluid in the outlet flow path 72 not more than the compliance of the piezoelectric element 64 which acts as an actuator, approximately 50% of the energy possessed by the piezoelectric element 64 can be extracted. Furthermore, by making the compliance of the fluid in the pump including the outlet flow path 72 and pumping chamber 66 not more than the piezoelectric element 64, not less than approximately 50% of the energy possessed by the piezoelectric element 64 can be extracted.

More preferably, by making the compliance of the fluid in the outlet flow path 72 not more than ⅓ the compliance of the piezoelectric element 64 which acts as an actuator, approximately 75% of the energy possessed by the piezoelectric element 64 can be extracted. Furthermore, by making the compliance of the fluid in the pump including the outlet flow path 72 and pumping chamber 66 not more than ⅓ the piezoelectric element 64, not less than approximately 75% of the energy possessed by the piezoelectric element 64 can be extracted, making it possible to slash the size of the piezoelectric element 64 or lower the voltage applied to the piezoelectric element 64 drastically.

The relationships described above will be calculated using actual values.

The piezoelectric element 64 used has a Young's modulus value of 4.4E10 N/m$^2$, diameter of 5 mm, length of 10 mm, and maximum displacement of 6 μm. The diaphragm 62 is 5 mm in diameter as with the piezoelectric element 64. Then, the following values are calculated: the maximum generated force of the piezoelectric element 64 is 518 N, the energy possessed by the piezoelectric element 64 is 1.56E−3J, and the compliance $C_{pzt}$ of the piezoelectric element 64 is 4.46E−7 cm$^3$/atm. The volume $V_0$ displaced by the diaphragm 62 is 1.18E−4 cm$^3$.

The fluid resistance R, inertance L, and compliance C of the outlet flow path 72 when the diameter ϕ and length l of the outlet flow path 72 are varied are shown in the tables below. It is assumed here that the compressibility, kinematic viscosity, and density of the fluid are 4.9E−10 1/Pa, 1E−6 m$^2$/s, and 1E3 kg/m$^3$, respectively.

TABLE 1

| ϕ [mm] | 1 [mm] | Resistance R [atm s/cm$^3$] | Inertance L [atm s$^2$/cm$^3$] | Compliance C [cm$^3$/atm] |
|---|---|---|---|---|
| 0.5 | 30 | 1.96E−01 | 1.53E−03 | 2.89E−07 |
| 0.5 | 20 | 1.30E−01 | 1.02E−03 | 1.92E−07 |
| 0.5 | 10 | 6.52E−02 | 5.09E−04 | 9.62E−08 |
| 0.5 | 4 | 2.61E−02 | 2.04E−04 | 3.85E−08 |
| 0.5 | 2 | 1.30E−02 | 1.02E−04 | 1.92E−08 |
| 0.5 | 1 | 6.52E−03 | 5.09E−05 | 9.62E−09 |
| 0.5 | 0.5 | 3.26E−03 | 2.55E−05 | 4.81E−09 |
| 0.5 | 0.1 | 6.52E−04 | 5.09E−06 | 9.62E−10 |
| 0.5 | 0.05 | 3.26E−04 | 2.55E−06 | 4.81E−10 |

TABLE 2

| ϕ [mm] | 1 [mm] | Resistance R [atm s/cm$^3$] | Inertance L [atm s$^2$/cm$^3$] | Compliance C [cm$^3$/atm] |
|---|---|---|---|---|
| 1 | 30 | 1.22E−02 | 3.82E−04 | 1.15E−06 |
| 1 | 20 | 8.15E−03 | 2.55E−04 | 7.70E−07 |
| 1 | 10 | 4.07E−03 | 1.27E−04 | 3.85E−07 |
| 1 | 4 | 1.63E−03 | 5.09E−05 | 1.54E−07 |
| 1 | 2 | 8.15E−04 | 2.55E−05 | 7.70E−08 |
| 1 | 1 | 4.07E−04 | 1.27E−05 | 3.85E−08 |
| 1 | 0.5 | 2.04E−04 | 6.37E−06 | 1.92E−08 |
| 1 | 0.1 | 4.07E−05 | 1.27E−06 | 3.85E−09 |
| 1 | 0.05 | 2.04E−05 | 6.37E−07 | 1.92E−09 |

TABLE 3

| ϕ [mm] | 1 [mm] | Resistance R [atm s/cm$^3$] | Inertance L [atm s$^2$/cm$^3$] | Compliance C [cm$^3$/atm] |
|---|---|---|---|---|
| 0.1 | 30 | 1.22E+02 | 3.82E−02 | 1.15E−08 |
| 0.1 | 20 | 8.15E+01 | 2.55E−02 | 7.70E−09 |
| 0.1 | 10 | 4.07E+01 | 1.27E−02 | 3.85E−09 |
| 0.1 | 4 | 1.63E+01 | 5.09E−03 | 1.54E−09 |
| 0.1 | 2 | 8.15E+00 | 2.55E−03 | 7.70E−10 |
| 0.1 | 1 | 4.07E+00 | 1.27E−03 | 3.85E−10 |
| 0.1 | 0.5 | 2.04E+00 | 6.37E−04 | 1.92E−10 |
| 0.1 | 0.1 | 4.07E−01 | 1.27E−04 | 3.85E−11 |
| 0.1 | 0.05 | 2.04E−01 | 6.37E−05 | 1.92E−11 |
| 0.1 | 0.01 | 4.07E−02 | 1.27E−05 | 3.85E−12 |

By varying the diameter ϕ and length l of the outlet flow path, the output energy Emax of the piezoelectric element is calculated based on Equation 6 and the flow velocity $Q_{(T)}$ of the outlet flow path when the output energy Emax is produced by the piezoelectric element is calculated based on Equation 5. They are shown in the following tables together with the ratio between the energy stored in the inertance of the fluid in the outlet flow path and energy E possessed by the piezoelectric element.

TABLE 4

| ϕ [mm] | 1 [mm] | PZT output energy Emax [J] | Q(T) [cm³/s] | Energy stored in inertance/energy possessed by PZT |
|---|---|---|---|---|
| 1 | 30 | 4.34E−04 | 4.76E+00 | 27.87% |
| 1 | 20 | 5.71E−04 | 6.70E+00 | 36.71% |
| 1 | 10 | 8.35E−04 | 1.15E+01 | 53.71% |
| 1 | 4 | 1.16E−03 | 2.13E+01 | 74.28% |
| 1 | 2 | 1.33E−03 | 3.23E+01 | 85.21% |
| 1 | 1 | 1.43E−03 | 4.74E+01 | 92.00% |
| 1 | 0.5 | 1.49E−03 | 6.84E+01 | 95.74% |
| 1 | 0.1 | 1.54E−03 | 1.55E+02 | 98.37% |
| 1 | 0.05 | 1.55E−03 | 2.19E+02 | 98.13% |

TABLE 5

| ϕ [mm] | 1 [mm] | PZT output energy Emax [J] | Q(T) [cm³/s] | Energy stored in inertance/energy possessed by PZT |
|---|---|---|---|---|
| 0.5 | 30 | 9.44E−04 | 3.51E+00 | 60.42% |
| 0.5 | 20 | 1.09E−03 | 4.61E+00 | 69.61% |
| 0.5 | 10 | 1.28E−03 | 7.08E+00 | 81.97% |
| 0.5 | 4 | 1.43E−03 | 1.18E+01 | 91.85% |
| 0.5 | 2 | 1.49E−03 | 1.71E+01 | 95.65% |
| 0.5 | 1 | 1.52E−03 | 2.44E+01 | 97.54% |
| 0.5 | 0.5 | 1.54E−03 | 3.46E+01 | 98.24% |
| 0.5 | 0.1 | 1.55E−03 | 7.69E+01 | 96.91% |
| 0.5 | 0.05 | 1.55E−03 | 1.07E+02 | 94.19% |

TABLE 6

| ϕ [mm] | 1 [mm] | PZT output energy Emax [J] | Q(T) [cm³/s] | Energy stored in inertance/energy possessed by PZT |
|---|---|---|---|---|
| 0.1 | 30 | 1.52E−03 | 6.74E−01 | 55.71% |
| 0.1 | 20 | 1.53E−03 | 8.72E−01 | 62.23% |
| 0.1 | 10 | 1.54E−03 | 1.32E−00 | 71.41% |
| 0.1 | 4 | 1.55E−03 | 2.21E+00 | 79.95% |
| 0.1 | 2 | 1.55E−03 | 3.19E+00 | 83.52% |
| 0.1 | 1 | 1.55E−03 | 4.54E+00 | 84.22% |
| 0.1 | 0.5 | 1.55E−03 | 6.30E+00 | 81.25% |
| 0.1 | 0.1 | 1.55E−03 | 1.17E+01 | 55.78% |
| 0.1 | 0.05 | 1.56E−03 | 1.39E+01 | 39.45% |
| 0.1 | 0.01 | 1.56E−03 | 1.69E+01 | 11.72% |

It can be seen from the tables how the ratio between the energy stored in the inertance of the fluid in the outlet flow path 72 and energy possessed by the piezoelectric element (PZT) varies with the diameter ϕ and length l of the outlet flow path 72. In this way, in order to output the energy possessed by the piezoelectric element 64 and convert it effectively into kinetic energy of the fluid in the outlet flow path 72, the diameter ϕ and length l of the outlet flow path 72 should be determined such that the ratio between the energy stored in the inertance of the fluid in the outlet flow path 72 and energy possessed by the piezoelectric element will not be less than 25%. Preferably, the diameter ϕ and length l of the outlet flow path 72 should be determined such that the ratio between the energy stored in the inertance of the fluid in the outlet flow path 72 and energy possessed by the piezoelectric element will not be less than 50%.

Figure 7:
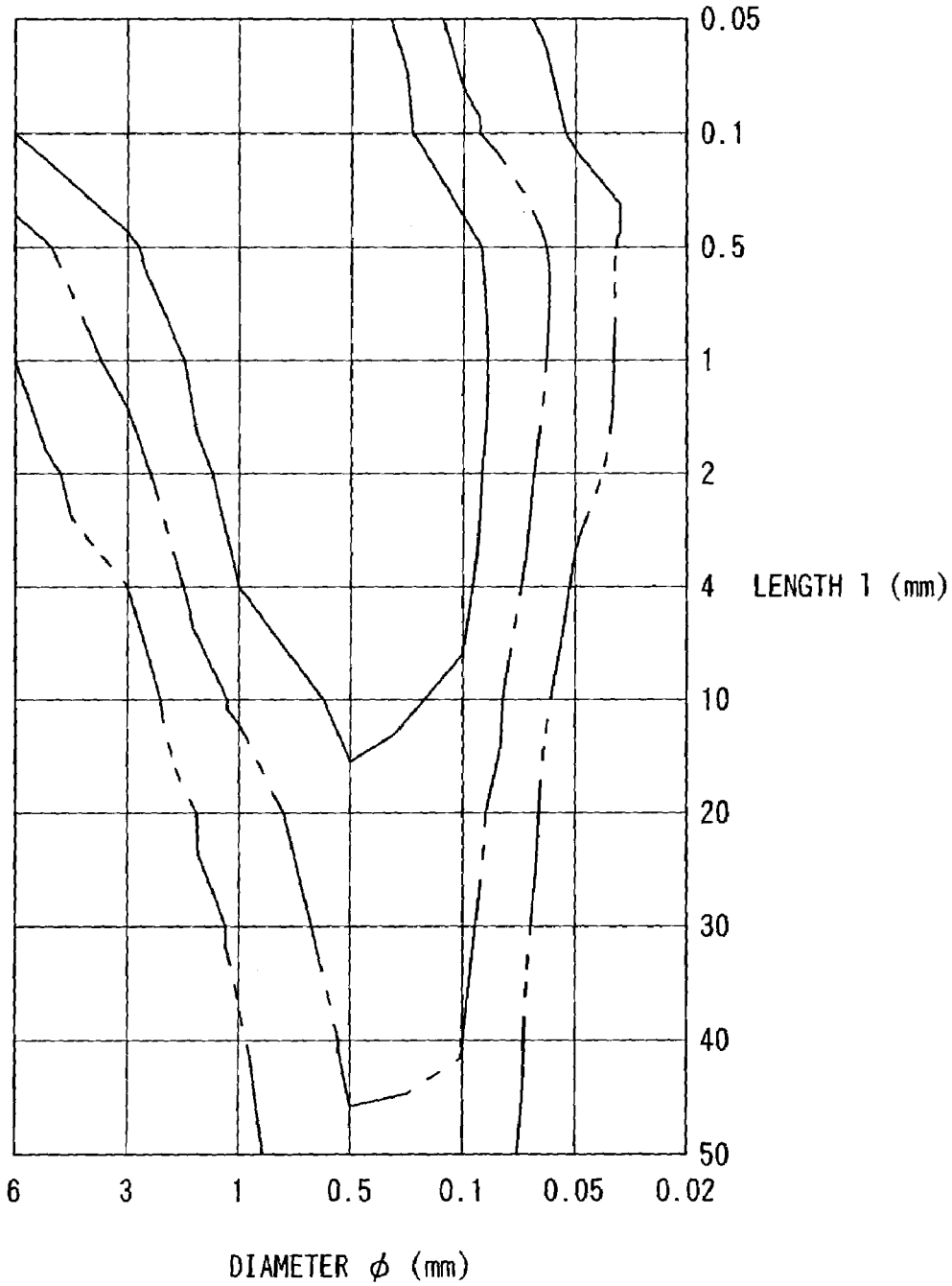
FIG. 7 is a graph showing the relation between the outlet flow path size and the ratios between energy stored in inertance of fluid in an outlet flow path and energy possessed by a piezoelectric element when the diameters of the piezoelectric element and diaphragm are 5 mm in the pump according to the fourth embodiment.

By varying the diameter ϕ and length l of the outlet flow path 72 in wider ranges under otherwise the same conditions as the tables above, the ratio between the energy stored in the inertance of the fluid in the outlet flow path 72 and energy possessed by the piezoelectric element (PZT) were determined and the results are shown as a graph in FIG. 7.

In FIG. 7, the horizontal axis represents the diameter ϕ [mm] and the vertical axis represents the length l [mm] of the outlet flow path 72. In the area enclosed by the solid line, the ratio between the energy stored in the inertance of the fluid in the outlet flow path 72 and energy possessed by the piezoelectric element is 75% or higher. In the area enclosed by the alternate long and short dash line, the ratio between the energy stored in the inertance of the fluid in the outlet flow path 72 and energy possessed by the piezoelectric element is 50% or higher. In the area enclosed by the chain double-dashed line, the ratio between the energy stored in the inertance of the fluid in the outlet flow path 72 and energy possessed by the piezoelectric element is 25% or higher.

Next, a case in which the piezoelectric element 64 and diaphragm 62 have the same diameter 10 mm is shown. The following values are calculated: the maximum generated force of the piezoelectric element 64 is 2070 N, the energy possessed by the piezoelectric element 64 is 6.22E−3 J, and the compliance $C_{pzt}$ of the piezoelectric element 64 is 1.78E−6 cm³/atm. The volume $V_0$ displaced by the diaphragm 62 is 4.71E−4 cm³.

By varying the diameter ϕ and length l of the outlet flow path, the output energy Emax of the piezoelectric element is calculated based on Equation 6 and the flow velocity $Q_{(T)}$ when the output energy Emax is produced by the piezoelectric element 64 is calculated based on Equation 5. They are shown in the following tables together with the ratio between the energy stored in the inertance of the fluid in the outlet flow path 72 and energy E possessed by the piezoelectric element 64.

TABLE 7

| ϕ [mm] | 1 [mm] | PZT output energy Emax [J] | Q(T) [cm³/s] | Energy stored in inertance/energy possessed by PZT |
|---|---|---|---|---|
| 1 | 50 | 2.99E−03 | 9.69E+00 | 48.02% |
| 1 | 40 | 3.34E−03 | 1.14E+01 | 53.60% |
| 1 | 30 | 3.78E−03 | 1.41E+01 | 60.63% |
| 1 | 20 | 4.35E−03 | 1.85E+01 | 69.78% |
| 1 | 10 | 5.12E−03 | 2.83E+01 | 82.18% |
| 1 | 4 | 5.73E−03 | 4.74E+01 | 91.95% |
| 1 | 2 | 5.96E−03 | 6.84E+01 | 95.69% |
| 1 | 1 | 6.09E−03 | 9.76E+01 | 97.58% |
| 1 | 0.5 | 6.15E−03 | 1.39E+02 | 98.33% |
| 1 | 0.1 | 6.21E−03 | 3.08E+02 | 96.87% |
| 1 | 0.05 | 6.21E−03 | 4.29E+02 | 94.23% |

TABLE 8

| ϕ [mm] | 1 [mm] | PZT output energy Emax [J] | Q(T) [cm³/s] | Energy stored in inertance/energy possessed by PZT |
|---|---|---|---|---|
| 0.5 | 50 | 4.90E−03 | 6.16E+00 | 77.74% |
| 0.5 | 40 | 5.12E−03 | 7.05E+00 | 81.31% |
| 0.5 | 30 | 5.35E−03 | 8.33E+00 | 85.22% |
| 0.5 | 20 | 5.62E−03 | 1.05E+01 | 89.53% |
| 0.5 | 10 | 5.90E−03 | 1.52E+01 | 94.27% |
| 0.5 | 4 | 6.09E−03 | 2.44E+01 | 97.28% |
| 0.5 | 2 | 6.15E−03 | 3.46E+01 | 98.12% |
| 0.5 | 1 | 6.19E−03 | 4.90E+01 | 98.13% |
| 0.5 | 0.5 | 6.20E−03 | 6.89E+01 | 97.28% |
| 0.5 | 0.1 | 6.22E−03 | 1.48E+02 | 89.19% |
| 0.5 | 0.05 | 6.22E−03 | 1.98E+02 | 80.60% |

TABLE 9

| ϕ [mm] | l [mm] | PZT output energy Emax [J] | Q(T) [cm³/s] | Energy stored in inertance/energy possessed by PZT |
|---|---|---|---|---|
| 0.1 | 50 | 6.15E−03 | 7.10E−01 | 25.77% |
| 0.1 | 40 | 6.17E−03 | 8.46E−01 | 29.30% |
| 0.1 | 30 | 6.18E−03 | 1.05E+00 | 34.03% |
| 0.1 | 20 | 6.19E−03 | 1.41E+00 | 40.83% |
| 0.1 | 10 | 6.21E−03 | 2.25E+00 | 51.89% |
| 0.1 | 4 | 6.21E−03 | 3.92E+00 | 62.92% |
| 0.1 | 2 | 6.22E−03 | 5.70E+00 | 66.52% |
| 0.1 | 1 | 6.22E−03 | 7.93E+00 | 64.35% |
| 0.1 | 0.5 | 6.22E−03 | 1.04E+01 | 55.78% |
| 0.1 | 0.1 | 6.22E−03 | 1.54E+01 | 24.21% |
| 0.1 | 0.05 | 6.22E−03 | 1.66E+01 | 14.04% |
| 0.1 | 0.01 | 6.22E−03 | 1.77E+01 | 3.21% |

Figure 8:
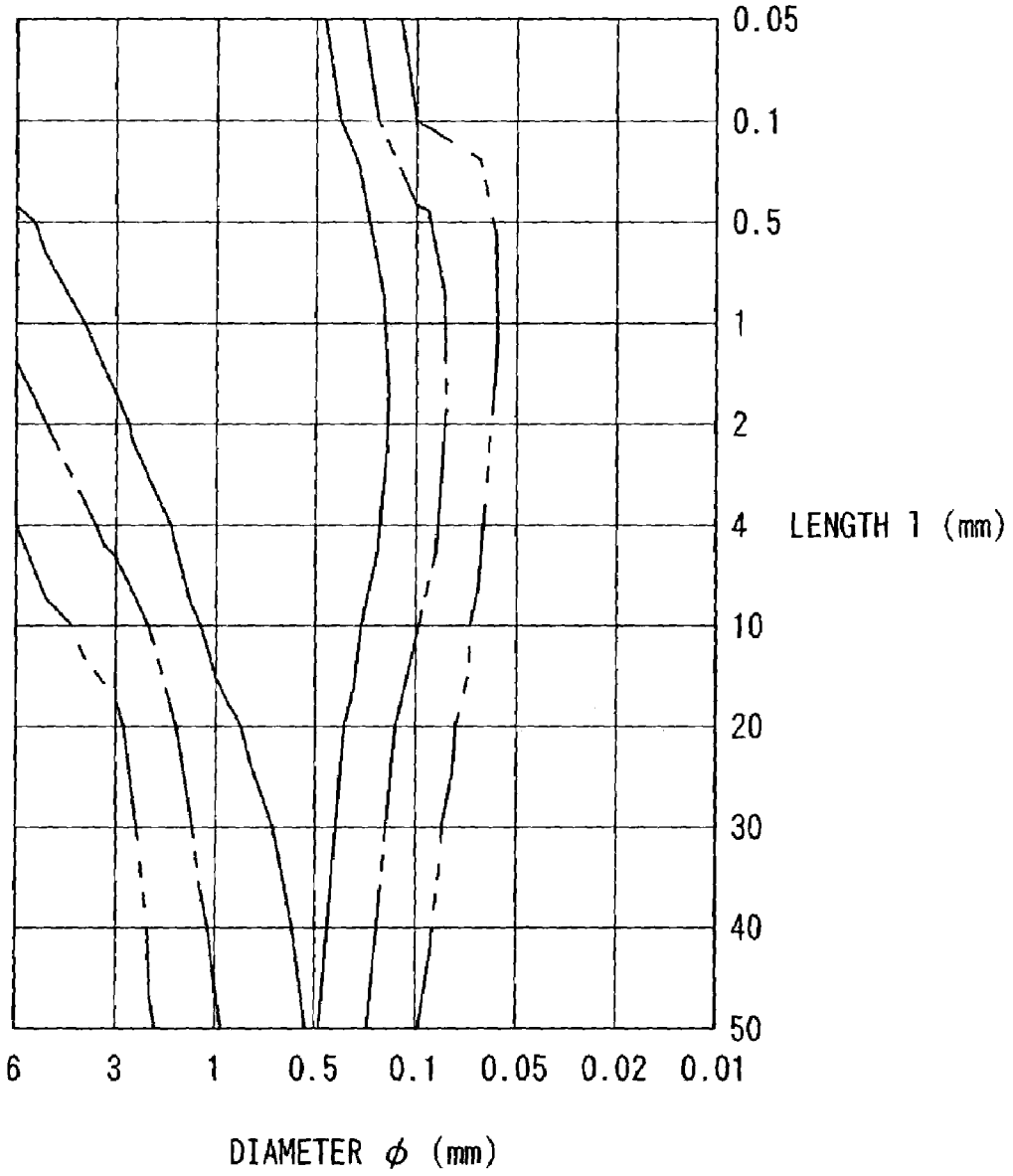
FIG. 8 is a graph showing the relation between the outlet flow path size and the ratios between energy stored in inertance of fluid in the outlet flow path and energy possessed by the piezoelectric element when the diameters of the piezoelectric element and diaphragm are 10 mm in the pump according to the fourth embodiment.

By varying the diameter ϕ and length l of the outlet flow path 72 in wider ranges under otherwise the same conditions as the tables above, the ratio between the energy stored in the inertance of the fluid in the outlet flow path 72 and energy possessed by the piezoelectric element (PZT) were determined and the results are shown as a graph in FIG. 8.

In FIG. 8, the horizontal axis represents the diameter ϕ [mm] and the vertical axis represents the length l of the outlet flow path 72. In the area enclosed by the solid line, the ratio between the energy stored in the inertance of the fluid in the outlet flow path 72 and energy possessed by the piezoelectric element is 50% or higher. In the area enclosed by the alternate long and short dash line, the ratio between the energy stored in the inertance of the fluid in the outlet flow path 72 and energy possessed by the piezoelectric element is 75% or higher. In the area enclosed by the chain double-dashed line, the ratio between the energy stored in the inertance of the fluid in the outlet flow path 72 and energy possessed by the piezoelectric element is 25% or higher.

Next, a case in which the piezoelectric element 64 and diaphragm 62 have the same diameter 2 mm is shown. The following values are calculated: the maximum generated force of the piezoelectric element 64 is 82.9N, the energy possessed by the piezoelectric element 64 is 2.49E−4 J, and the compliance $C_{pzt}$ of the piezoelectric element 64 is 7.14E−8 cm³/atm. The volume $V_0$ displaced by the diaphragm 62 is 1.88E−5 cm³.

By varying the diameter ϕ and length l of the outlet flow path 72, the output energy Emax of the piezoelectric element 64 is calculated based on Equation 6 and the flow velocity $Q_{(T)}$ when the output energy Emax is produced by the piezoelectric element 64 is calculated based on Equation 5. They are shown in the following tables together with the ratio between the energy stored in the inertance of the fluid in the outlet flow path 72 and energy E possessed by the piezoelectric element 64.

TABLE 10

| ϕ [mm] | l [mm] | PZT output energy Emax [J] | Q(T) [cm³/s] | Energy stored in inertance/energy possessed by PZT |
|---|---|---|---|---|
| 1 | 50 | 8.90E−06 | 5.28E−01 | 3.57% |
| 1 | 40 | 1.10E−05 | 6.58E−01 | 4.43% |
| 1 | 30 | 1.45E−05 | 8.71E−01 | 5.82% |
| 1 | 20 | 2.11E−05 | 1.29E+00 | 8.48% |
| 1 | 10 | 3.89E−05 | 2.47E+00 | 15.65% |
| 1 | 4 | 7.88E−05 | 5.56E+00 | 31.68% |
| 1 | 2 | 1.20E−04 | 9.70E+00 | 48.12% |
| 1 | 1 | 1.62E−04 | 1.59E+01 | 64.97% |
| 1 | 0.5 | 1.96E−04 | 2.48E+01 | 78.75% |

TABLE 10-continued

| ϕ [mm] | l [mm] | PZT output energy Emax [J] | Q(T) [cm³/s] | Energy stored in inertance/energy possessed by PZT |
|---|---|---|---|---|
| 1 | 0.1 | 2.36E−04 | 6.09E+01 | 94.77% |
| 1 | 0.05 | 2.42E−04 | 8.71E+01 | 97.14% |

TABLE 11

| ϕ [mm] | l [mm] | PZT output energy Emax [J] | Q(T) [cm³/s] | Energy stored in inertance/energy possessed by PZT |
|---|---|---|---|---|
| 0.5 | 50 | 3.22E−05 | 5.01E−01 | 12.84% |
| 0.5 | 40 | 3.89E−05 | 6.17E−01 | 15.56% |
| 0.5 | 30 | 4.93E−05 | 8.02E−01 | 19.75% |
| 0.5 | 20 | 6.73E−05 | 1.15E+00 | 26.99% |
| 0.5 | 10 | 1.06E−04 | 2.04E+00 | 42.53% |
| 0.5 | 4 | 1.62E−04 | 3.98E+00 | 64.92% |
| 0.5 | 2 | 1.96E−04 | 6.20E+00 | 78.71% |
| 0.5 | 1 | 2.19E−04 | 9.28E+00 | 88.05% |
| 0.5 | 0.5 | 2.33E−04 | 1.35E+01 | 93.58% |
| 0.5 | 0.1 | 2.46E−04 | 3.10E+01 | 98.19% |
| 0.5 | 0.05 | 2.47E−04 | 4.38E+01 | 98.38% |

TABLE 12

| ϕ [mm] | l [mm] | PZT output energy Emax [J] | Q(T) [cm³/s] | Energy stored in inertance/energy possessed by PZT |
|---|---|---|---|---|
| 0.1 | 50 | 1.96E−04 | 2.11E−01 | 57.03% |
| 0.1 | 40 | 2.05E−04 | 2.46E−01 | 61.99% |
| 0.1 | 30 | 2.14E−04 | 2.97E−01 | 67.72% |
| 0.1 | 20 | 2.25E−04 | 3.82E−01 | 74.52% |
| 0.1 | 10 | 2.36E−04 | 5.70E−01 | 83.06% |
| 0.1 | 4 | 2.44E−04 | 9.37E−00 | 89.91% |
| 0.1 | 2 | 2.46E−04 | 1.35E+00 | 92.83% |
| 0.1 | 1 | 2.47E−04 | 1.92E+00 | 94.38% |
| 0.1 | 0.5 | 2.48E−04 | 2.72E+00 | 94.66% |
| 0.5 | 0.1 | 2.49E−04 | 5.87E+00 | 88.16% |
| 0.1 | 0.05 | 2.49E−04 | 7.91E+00 | 79.97% |
| 0.1 | 0.01 | 2.49E−04 | 1.33E+01 | 45.33% |

Figure 9:
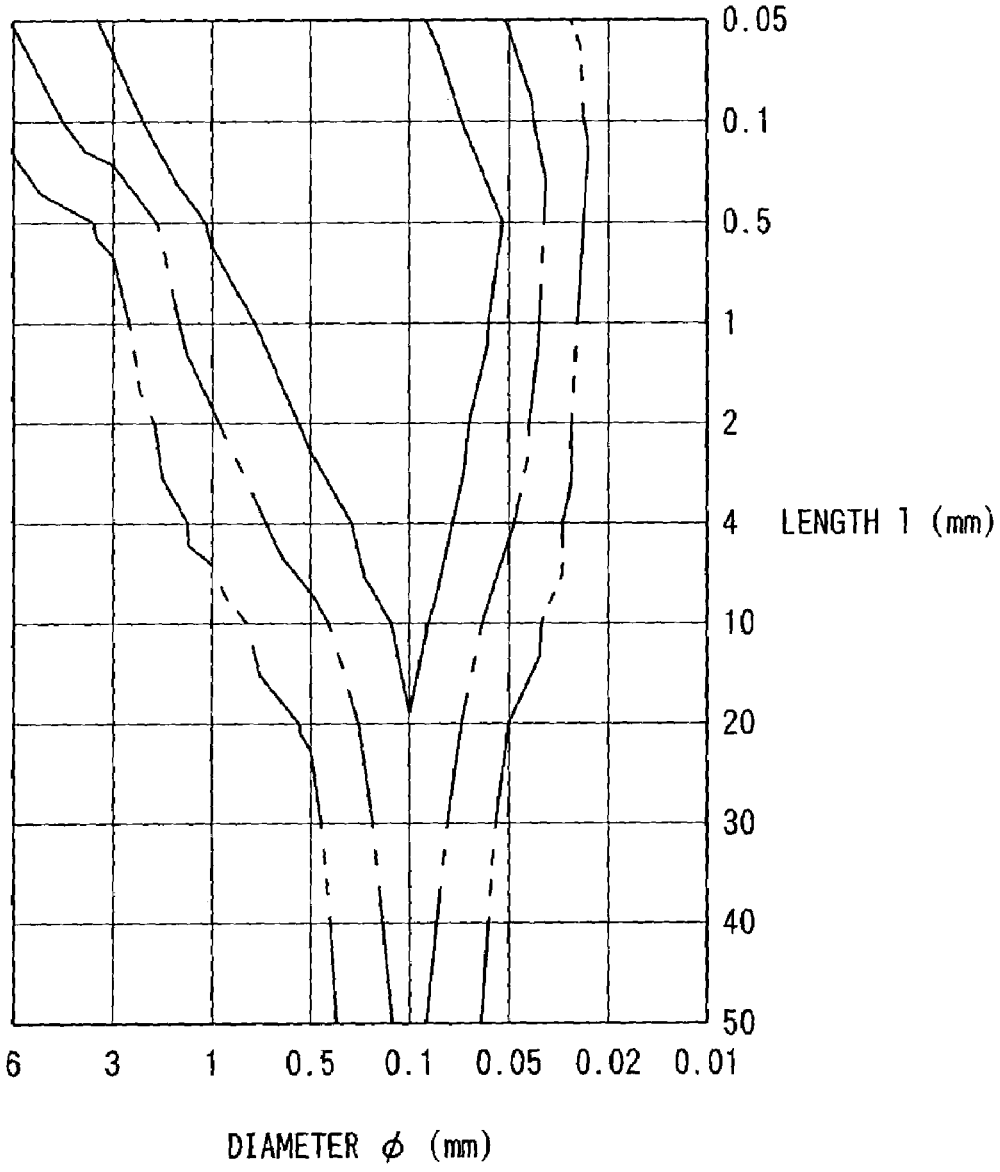
FIG. 9 is a graph showing the relation between the outlet flow path size and the ratios between energy stored in inertance of fluid in the outlet flow path and energy possessed by the piezoelectric element when the diameters of the piezoelectric element and diaphragm are 2 mm in the pump according to the fourth embodiment.

By varying the diameter ϕ and length l of the outlet flow path 72 in wider ranges under otherwise the same conditions as the tables above, the ratio between the energy stored in the inertance of the fluid in the outlet flow path 72 and energy possessed by the piezoelectric element (PZT) were determined and the results are shown as a graph in FIG. 9.

In FIG. 9, the horizontal axis represents the diameter ϕ [mm] and the vertical axis represents the length l [mm] of the outlet flow path 72. In the area enclosed by the solid line, the ratio between the energy stored in the inertance of the fluid in the outlet flow path 72 and energy possessed by the piezoelectric element is 75% or higher. In the area enclosed by the alternate long and short dash line, the ratio between the energy stored in the inertance of the fluid in the outlet flow path 72 and energy possessed by the piezoelectric element is 50% or higher. In the area enclosed by the chain double-dashed line, the ratio between the energy stored in the inertance of the fluid in the outlet flow path 72 and energy possessed by the piezoelectric element is 25% or higher.

When the length and equivalent diameter of the outlet flow path 72 are compared, if the length is too small relative to the equivalent diameter, the outlet flow path 72 becomes more like an orifice than a pipe. Consequently, fluid resistance increases sharply, leading to sharp increase in energy consumption and resulting in a drastic fall in the ratio between the energy stored in the inertance of the fluid in the outlet flow path 72 and energy possessed by the piezoelectric element. To avoid this situation, it is advisable that the length of the outlet flow path 72 be not less than ½ of the equivalent diameter. If the cross-sectional area of the outlet flow path 72 varies, the length of the outlet flow path 72 should be not less than ½ of the average equivalent diameter.

The equivalent diameter De is defined as follows:

$$De=4Af/Wp$$

where

Af: Cross-sectional area of flow path

Wp: Length of wall plane in cross section

As can be seen from the above description and FIGS. 7, 8, and 9, in order for the energy possessed by the piezoelectric element to be stored effectively in the inertance of the fluid in the outlet flow path 72, the dimensional ranges of the outlet flow path 72 should be as follows: the diameter $\phi$ should be between approximately 70 $\mu$m and 3 mm and the length of the flow path should be less than approximately 45 mm.

The terms "inertance" and "compliance" are the same as the terms which have been used in fields of the analogy of electricity and acoustics.

The diaphragms 4, 30, and 62 in the first to fourth embodiments are not limited to circular ones. Also, the actuators for driving the diaphragms are not limited to the piezoelectric elements 6, 34, and 64. They may be of any type as long as they expands and contracts. Also, the check valves 10, 42, and 68 are not limited to the type which opens and closes by differential pressure of fluid. They may be of a type that uses other than the differential pressure of fluid to control the opening and closing of the valve.

INDUSTRIAL APPLICABILITY

A pump which moves working fluid by changing the volume of its pumping chamber with a piston or diaphragm requires a check valve both in the inlet and outlet flow paths and has the problem that a fluid passing through two check valves suffers high pressure loss. Also, the check valves, which open and close repeatedly, are liable to fatigue damage. Besides, the larger the number of check valves, the lower the reliability. Another conventional configuration needs to increase the fluid resistance in the inlet flow path in order to reduce back-flow in the inlet flow path during the discharge stroke of the pump. Consequently, the suction stroke of the pump, during which the fluid is introduced into the pumping chamber against the fluid resistance, becomes considerably longer than the discharge stroke, resulting in a significantly low frequency of cycling between the pump's suction and discharge strokes. Thus, this configuration cannot implement a small, high-power pump. With another conventional pump, since it is configured to produce unidirectional net flow of the fluid passing through compression components as the volume of the pumping chamber increases and decreases, using the pressure drops which vary with the flow direction, the back-flow increases with increases in external pressure (load pressure) on the outlet side and the pump fails to operate under high load pressure.

In contrast to the conventional pumps described above, a pump according to the present invention comprises an actuator which displaces a movable wall such as a piston or diaphragm; a pumping chamber whose volume can be varied by the displacement of the movable wall; an inlet flow path through which a working fluid flows into the pumping chamber; and an outlet flow path through which the working fluid flows out of the pumping chamber, wherein the outlet flow path is in constant communication with the pumping chamber even when the pump is in operation, combined inertance value of the inlet flow path is smaller than combined inertance value of the outlet flow path, the inlet flow path is equipped with a fluid resistance element which makes the fluid resistance smaller when the working fluid flows into the pumping chamber than when the working fluid flows out, and a return inlet is installed where the cross-sectional area of the outlet flow path is at least twice the cross-sectional area of the narrowest part of the flow path leading out of the pumping chamber of the pump. The pump according to the present invention reduces the pressure loss caused by the check valve in the interval between the inlet flow path and outlet flow path as well as the pressure loss in the return inlet. Consequently, it can achieve small size, light weight, and high power.

What is claimed is:

1. A pump comprising: an actuator which displaces a movable wall; a pumping chamber whose volume can be varied by the displacement of the movable wall; an inlet flow path through which a working fluid flows into the pumping chamber; and an outlet flow path through which the working fluid flows out of the pumping chamber, wherein the outlet flow path is in constant communication with the pumping chamber even when the pump is in operation, combined inertance value of the inlet flow path is smaller than combined inertance value of the outlet flow path, the inlet flow path is equipped with a fluid resistance element which makes the fluid resistance smaller when the working fluid flows into the pumping chamber than when the working fluid flows out, and a return inlet is installed where the cross-sectional area of the outlet flow path is at least twice the cross-sectional area of the narrowest part of the flow path leading out of the pumping chamber of the pump.

2. The pump according to claim 1, comprising an active valve which communicates the inlet flow path and outlet flow path of the pump through a return inlet.

3. The pump according to claim 2, comprising an actuator made of shape-memory alloy to drive the active valve.

4. A pump comprising: an actuator which displaces a movable wall; a pumping chamber whose value can be varied by the displacement of the movable wall; a pressure chamber in communication with the pumping chamber via a connecting flow path; an inlet flow path though which a working fluid flows into the pressure chamber; and an outlet flow path through which the working fluid flows out of the pressure chamber, wherein the cross-sectional area of the connecting flow path is smaller than that of the pumping chamber, the outlet flow path is in constant communication with the pressure chamber even when the pump is in operation, combined inertance value of the inlet flow path is smaller than combined inertance value of the outlet flow path, and the inlet flow path is equipped with a fluid resistance element which makes the fluid resistance smaller when the working fluid flows into the pressure chamber than when the working fluid flows out, and further the outlet flow path is open in the flow direction of the working fluid flowing out of the fluid resistance element, and the pumping chamber is filled with fluid, and the connecting flow path is equipped with a membrane capable of deformation equivalent to volume changes of the pumping chamber.

5. The pump according to claim 1, wherein the actuator is a piezoelectric element.

6. The pump according to claim 1, wherein the actuator is a magnetostrictive element.

* * * * *